US011543089B2

(12) United States Patent
Dong et al.

(10) Patent No.: US 11,543,089 B2
(45) Date of Patent: Jan. 3, 2023

(54) LIGHTING APPARATUS

(71) Applicant: XIAMEN ECO LIGHTING CO. LTD., Xiamen (CN)

(72) Inventors: Yongzhe Dong, Xiamen (CN); Lei Zhang, Xiamen (CN); Zhirong Xie, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 17/504,352

(22) Filed: Oct. 18, 2021

(65) Prior Publication Data

US 2022/0120390 A1 Apr. 21, 2022

(30) Foreign Application Priority Data

Oct. 16, 2020 (CN) ..... 202022318428.4

(51) Int. Cl.

| | |
|---|---|
| ***F21S 2/00*** | (2016.01) |
| ***F21V 23/00*** | (2015.01) |
| ***F21V 7/00*** | (2006.01) |
| ***F21S 4/28*** | (2016.01) |
| ***F21V 17/02*** | (2006.01) |
| ***F21V 23/04*** | (2006.01) |
| ***F21V 17/20*** | (2006.01) |
| ***F21Y 115/10*** | (2016.01) |
| ***F21Y 103/10*** | (2016.01) |

(52) U.S. Cl.

CPC ..... *F21S 2/005* (2013.01); *F21S 4/28* (2016.01); *F21V 7/005* (2013.01); *F21V 7/0016* (2013.01); *F21V 7/0025* (2013.01); *F21V 17/02* (2013.01); *F21V 17/20* (2013.01); *F21V 23/007* (2013.01); *F21V 23/009* (2013.01); *F21V 23/04* (2013.01); *F21Y 2103/10* (2016.08); *F21Y 2115/10* (2016.08)

(58) Field of Classification Search

CPC ..... F21S 4/28; F21V 7/0016; F21V 7/0025; F21V 7/005; F21V 17/02; F21V 17/20

See application file for complete search history.

(56) References Cited

U.S. PATENT DOCUMENTS

| | | | | |
|---|---|---|---|---|
| 9,200,782 | B1 * | 12/2015 | Erickson | F21V 7/04 |
| 2014/0355272 | A1 * | 12/2014 | Chou | F21S 8/04 29/592.1 |
| 2016/0131311 | A1 * | 5/2016 | Qin | A47F 7/0071 362/225 |
| 2019/0293262 | A1 * | 9/2019 | Yin | F21V 17/04 |

* cited by examiner

*Primary Examiner* — William N Harris

(74) *Attorney, Agent, or Firm* — Chun-Ming Shih; Lanway IPR Services

(57) ABSTRACT

A lighting apparatus includes a bottom cover, a first reflective plate, a second reflective plate, a light source and a light passing cover. The bottom cover has a first wall, a second wall and a bottom plate. The first wall has a first bottom edge fixed to the bottom plate. The second wall has a second bottom edge fixed to the bottom plate. The first reflective plate has a first upper side attached to a first top edge of the first wall. The second reflective plate has a second upper side attached to a second top edge of the second wall. The light source is placed between a first lower side of the first reflective plate and a second lower side of the second reflective plate.

19 Claims, 6 Drawing Sheets

LIGHTING APPARATUS

FIELD

The present invention is related to a lighting apparatus, and more particularly related to a lighting apparatus with an easy assembly structure.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

It is important to provide flexible settings to satisfy different needs of users.

When providing such function, it is also important to consider cost and complexity of the design so as to increase.

SUMMARY

In some embodiments, a lighting apparatus includes a bottom cover, a first reflective plate, a second reflective plate, a light source and a light passing cover.

The bottom cover has a first wall, a second wall and a bottom plate.

The first wall has a first bottom edge fixed to the bottom plate.

The second wall has a second bottom edge fixed to the bottom plate.

The first reflective plate has a first upper side attached to a first top edge of the first wall.

The second reflective plate has a second upper side attached to a second top edge of the second wall.

The light source is placed between a first lower side of the first reflective plate and a second lower side of the second reflective plate.

A light passing cover is mounted between the first lower side of the first reflective plate and the second lower side of the second reflective plate.

The light source emits a first light passing through the light passing cover.

The light source emits a second light with directions guided by the first reflective plate and the second reflective plate.

In some embodiments, a first angle between the first top edge of the first wall and the upper side of the first reflective plate is smaller than 90 degrees.

In some embodiments, the first upper side of the first reflective plate has larger distance to the bottom plate than the first lower side of the first reflective plate to the bottom plate.

In some embodiments, the first angle is adjustable to change a first tilt angle of the first reflective plate with respect to the bottom plate.

In some embodiments, a first rotation connector attaches the first upper side of the first reflective plate to the top edge of the first wall.

In some embodiments, the first rotation connector has a lever to release connection of the first upper side of the first reflective plate to the first top edge of the first wall.

In some embodiments, the rotation connector has an elastic unit for generating an elastic force for attaching the first reflective plate to the first wall while no external force is applied on the lever.

In some embodiments, the lower side of the first reflective plate is attached to the bottom plate with a first pressing rotator.

The first pressing rotator has a pin being rotated to press the first lower side of the first reflective plate to the bottom plate.

In some embodiments, the first pressing rotator is concealed by the light passing cover.

In some embodiments, the lighting apparatus may also include a manual switch.

The manual switch is concealed by the light passing cover.

The manual switch is operated to change a setting of the light source.

In some embodiments, the light source includes at least one light strip containing LED modules.

In some embodiments, the light strip has a light cover to prevent engagement of human to the LED modules enclosed by the light cover.

In some embodiments, a driver is enclosed by the first wall, the first reflective cover and the bottom plate.

In some embodiments, the first reflective plate has a metal substrate.

In some embodiments, the first lower side of the first reflective plate has a first bending part.

The bending part has a first protruding pin for buckling a first cover edge of the light passing cover.

In some embodiments, the light passing cover is made of plastic material.

In some embodiments, the first cover edge of the light passing cover is pressed to deform for the first cover edge to escape from the first protruding pin.

In some embodiments, the first bending part and the first protruding pin are made of the same metal piece of the first reflective plate.

In some embodiments, heat of the light source is transmitted to the first reflective plate.

In some embodiments, a metal path is disposed for guiding heat of the light source to the first reflective plate.

DETAILED DESCRIPTION

Figure 8:
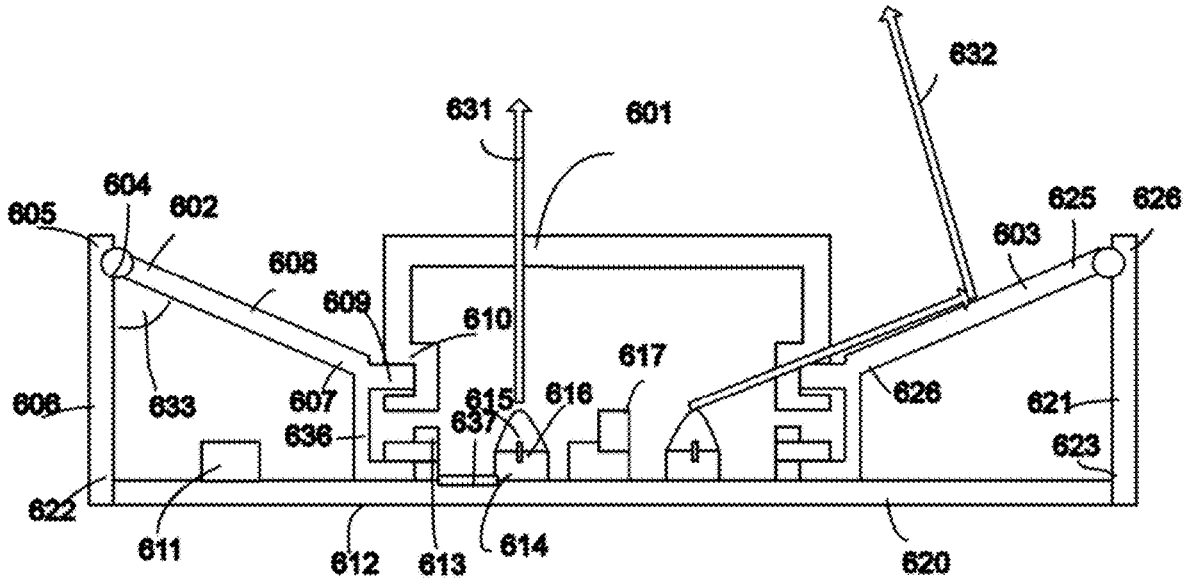
FIG. 8 illustrates another lighting apparatus embodiment.

In FIG. 8, a lighting apparatus includes a bottom cover 620, a first reflective plate 608, a second reflective plate 603, a light source 614 and a light passing cover 601.

The bottom cover 620 has a first wall 606, a second wall 621 and a bottom plate 612.

The first wall 606 has a first bottom edge 622 fixed to the bottom plate 612.

The second wall 621 has a second bottom edge 623 fixed to the bottom plate 612.

The first reflective plate 608 has a first upper side 602 attached to a first top edge 605 of the first wall 606.

The second reflective plate 603 has a second upper side 625 attached to a second top edge 626 of the second wall 621.

The light source 614 is placed between a first lower side 607 of the first reflective plate 608 and a second lower side 626 of the second reflective plate 603.

A light passing cover 601 is mounted between the first lower side 607 of the first reflective plate 608 and the second lower side 626 of the second reflective plate 603.

The light source 614 emits a first light 631 passing through the light passing cover 601.

The light source 614 emits a second light 632 with directions guided by the first reflective plate 608 and the second reflective plate 603.

In some embodiments, a first angle 633 between the first top edge 605 of the first wall 606 and the upper side 602 of the first reflective plate 608 is smaller than 90 degrees. For example, the first angle 633 may be 75 degrees. In some embodiment, the first angle 633 is between 80 to 45 degrees.

In some embodiment, the first reflective plate 608 and the second reflective plate 603 have a curve surface for changing a reflected light angle.

In some embodiments, the first upper side 602 of the first reflective plate 608 has larger distance to the bottom plate 612 than the first lower side 607 of the first reflective plate 608 to the bottom plate 612.

In some embodiments, the first angle 633 is adjustable to change a first tilt angle of the first reflective plate 608 with respect to the bottom plate 612.

For example, a moving connector may be used for attaching the first reflective plate to the first wall. By changing a relative position of the first reflective plate to the first wall, the tilt angle may be adjusted. Sliding tracks may be used together with a curvature of the first wall may be arranged to implement such embodiments.

In some embodiments, a first rotation connector 604 attaches the first upper side 602 of the first reflective plate 608 to the top edge 605 of the first wall 606.

In some embodiments, the first rotation connector 604 has a lever to release connection of the first upper side 602 of the first reflective plate 608 to the first top edge 605 of the first wall 606.

Figure 6:
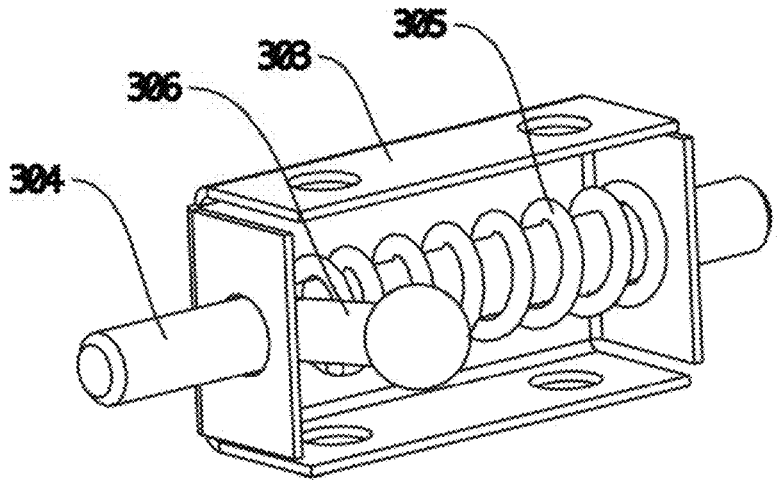
FIG. 6 illustrates an inside view of the example in FIG. 5.

FIG. 6 shows an example of such rotation connector that has a housing 303. In FIG. 6, there is a lever 306 to be operated to release a connection between the first reflective plate and the first wall. The shaft 304 is inserted to one of the first wall and the first reflective plate. In the following description, the first reflective plate is symmetric to the second reflective plate and the elements and features may also be applied to the second reflective plate.

In FIG. 6, the rotation connector has an elastic unit 305 for generating an elastic force for attaching the first reflective plate to the first wall while no external force is applied on the lever.

In FIG. 8, the lower side 607 of the first reflective plate 608 is attached to the bottom plate 612 with a first pressing rotator 613.

Figure 7:
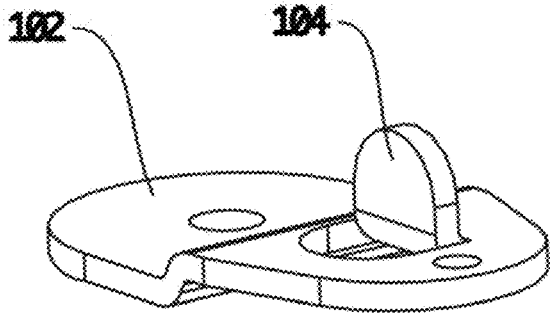
FIG. 7 illustrates an pressing rotator example.

FIG. 7 shows an example of such first pressing rotator. In FIG. 7 and FIG. 6, the first pressing rotator has a pin 102 being rotated to press the first lower side 607 of the first reflective plate 608 to the bottom plate 612. Users hold the holding plate 104 to rotate the pin to release or lock the first reflective plate from or to the bottom plate 612.

In FIG. 8, the first pressing rotator 613 is concealed by the light passing cover 601.

In some embodiments, the lighting apparatus may also include a manual switch 617.

The manual switch 617 is concealed by the light passing cover 601. Therefore, the manual switch 617 may be set by detaching the light passing cover 601. The setting may indicate a desired color temperature, a maximum light intensity or other optical features of the light source. The manual switch 617 may be connected to a driver 611. The driver 611 retrieves the setting and generates corresponding driving currents to different types of LED modules 616 of the light source 614 to mix a required optical features.

The manual switch 617 is operated to change a setting of the light source 614.

In some embodiments, the light source 614 includes at least one light strip containing LED modules 614.

In some embodiments, the light strip has a light cover 615 to prevent engagement of human to the LED modules enclosed by the light cover 601.

In other words, even the light passing cover 601 is detached, users are not electrically contact to unprotected components. Such design also prevents water or dust to damage the light source.

In some embodiments, a driver 611 is enclosed by the first wall 606, the first reflective cover 608 and the bottom plate 612.

In some embodiments, the first reflective plate has a metal substrate.

In some embodiments, the first lower side 607 of the first reflective plate 608 has a first bending part 636.

The bending part 636 has a first protruding pin 609 for buckling a first cover edge 610 of the light passing cover 601.

In some embodiments, the light passing cover 601 is made of plastic material.

In some embodiments, the first cover edge 610 of the light passing cover 601 is pressed to deform for the first cover edge 610 to escape from the first protruding pin 609.

In some embodiments, the first bending part 636 and the first protruding pin 609 are made of the same metal piece of the first reflective plate 608. For example, a single metal plate may be stamped or bent to form the structure as described above.

In some embodiments, heat of the light source is transmitted to the first reflective plate.

In some embodiments, a metal path 637 is disposed for guiding heat of the light source 614 to the first reflective plate 608.

Figure 1:
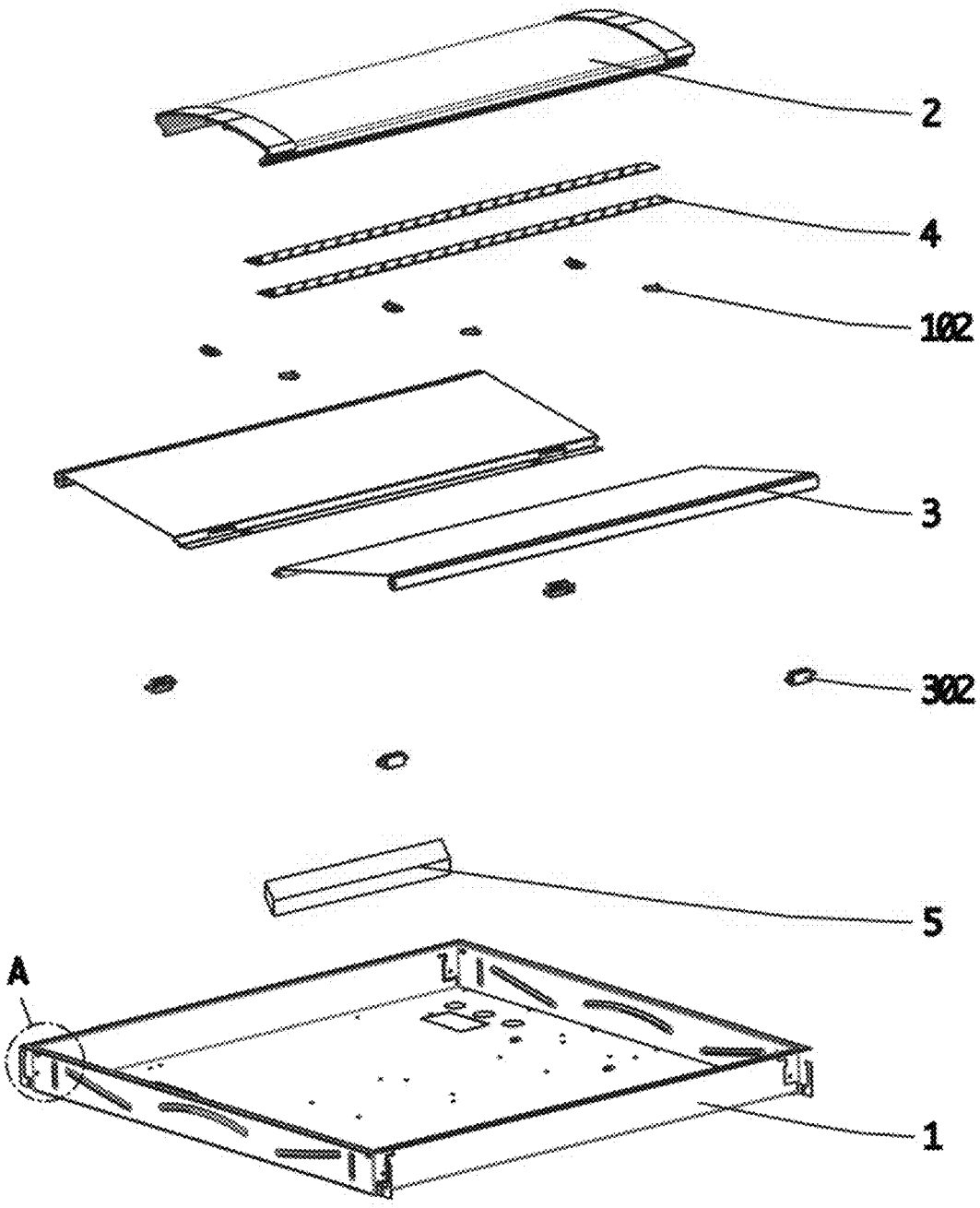
FIG. 1 illustrates an exploded view of a lighting apparatus embodiment.

Please refer to FIG. 1, which illustrates a lighting apparatus embodiment.

In FIG. 1, the lighting apparatus has a light passing cover 2, which may be used for diffusing light or to condensing light to form light beams, depending on design factors.

The light source includes two light strips 4. There are multiple pressing rotators 102. There are two reflective plates 3. The reflective plates 3 are attached to a wall of the bottom cover 1 with rotation connectors 302. There is a driver 5 used for generating driving currents to the LED modules of the light strips 4.

Figure 2:
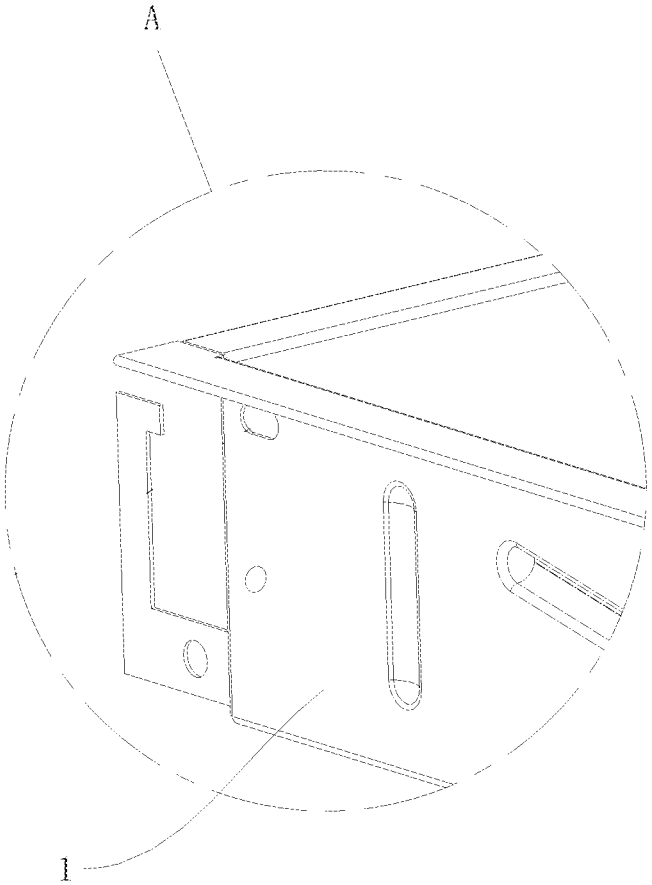
FIG. 2 illustrates a zoom-up view of a connection of the example in FIG. 1.

FIG. 2 shows a zoom-up view of a connection of components in the example of FIG. 1. In FIG. 2, there is an insertion hole for inserting the rotation connector to attach to the bottom cover 1.

Figure 3:
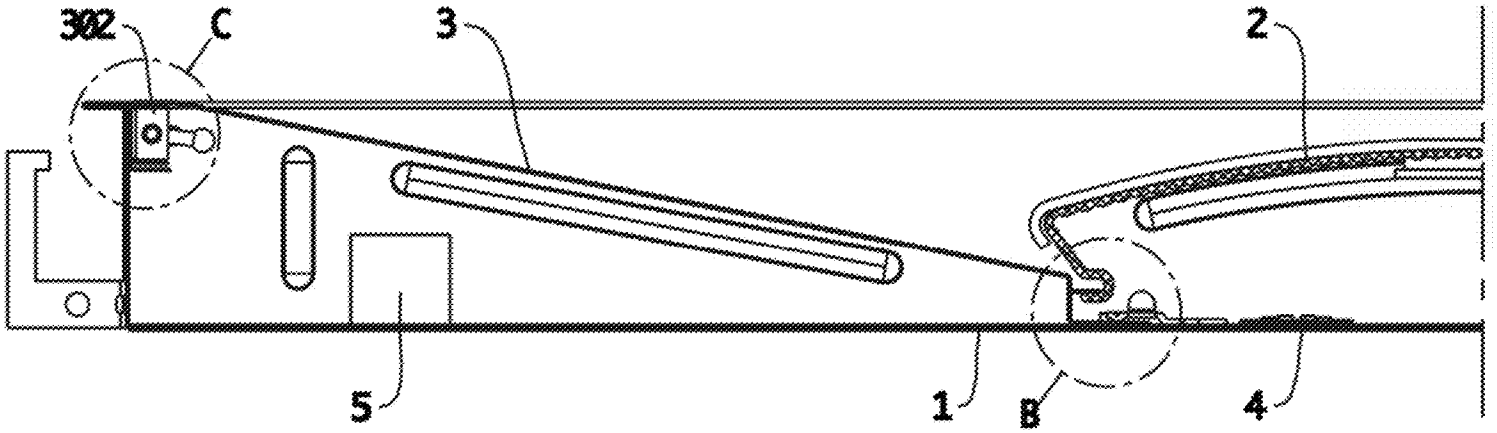
FIG. 3 illustrates a cross-sectional view of the example in FIG. 1.

FIG. 3 shows a cross-sectional view of the example of FIG. 1.

In FIG. 3, the light passing cover conceals the light strip 4. Other components with the same reference numerals among different drawings refer to the same components.

Figure 4:
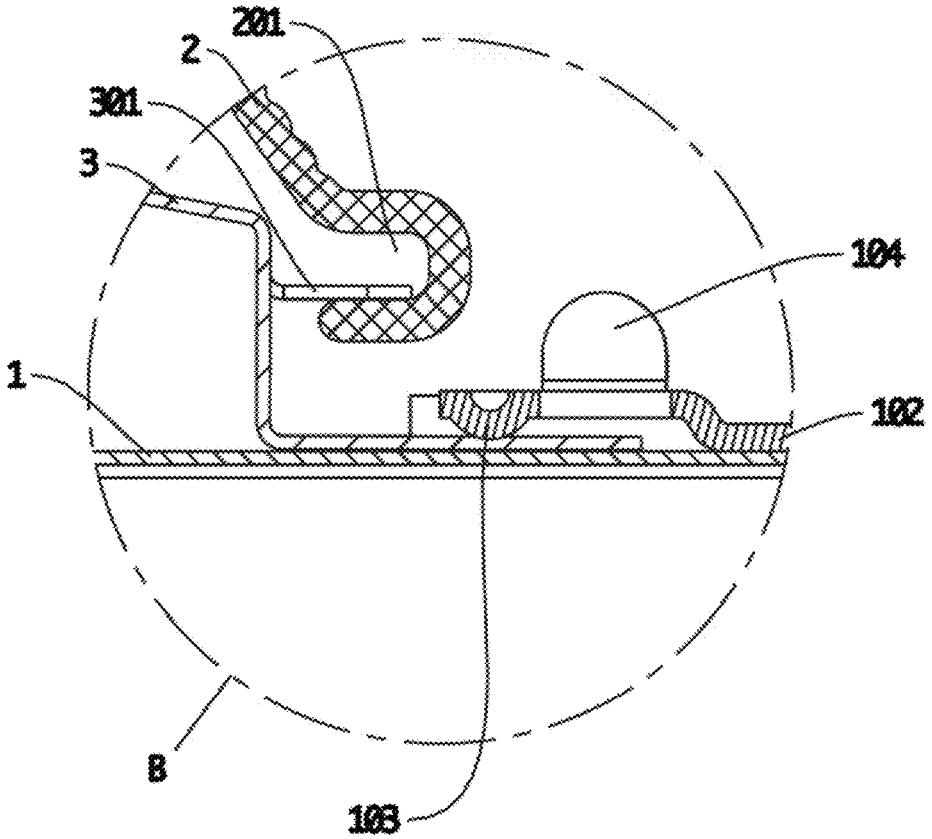
FIG. 4 illustrates a zoom-up view of another connection of the example in FIG. 1.

The area B is further illustrated in FIG. 4. The area C is further illustrated in FIG. 5.

In FIG. 4, the pressing rotator 102 has a holding plate 104 for changing a position of a pin 103 to release or to lock to the reflective plate 3 to the bottom cover 1.

There is a protruding pin 301 buckling a groove 201 of the light passing cover 2.

Figure 5:
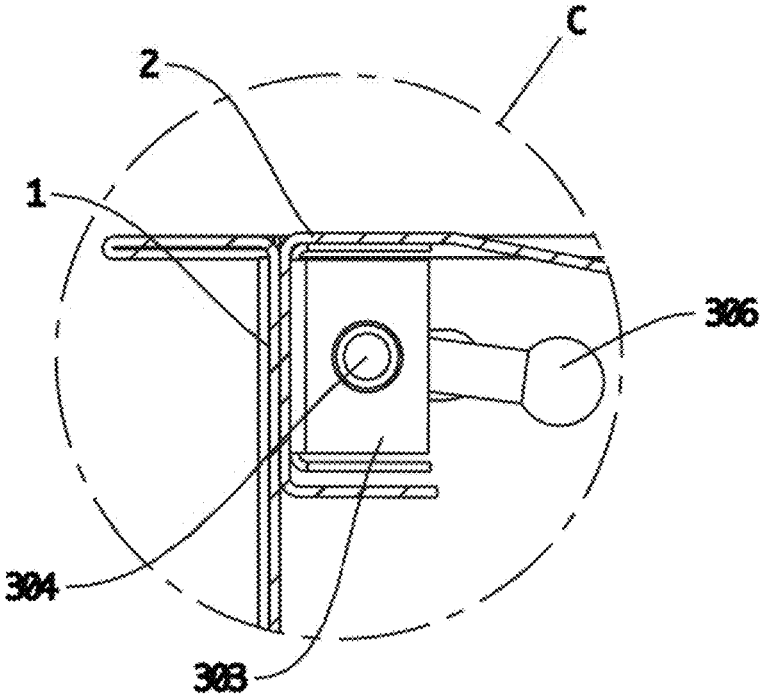
FIG. 5 illustrates a rotation connector example.

In FIG. 5, the lever 306 of the rotation connector is protruding from the housing 303 to detach connection among components.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a bottom cover having a first wall, a second wall, and a bottom plate, wherein the first wall has a first bottom edge fixed to the bottom plate, wherein the second wall has a second bottom edge fixed to the bottom plate;

a first reflective plate with a first upper side attached to a first top edge of the first wall;

a second reflective plate with a second upper side attached to a second top edge of the second wall;

a light source placed between a first lower side of the first reflective plate and a second lower side of the second reflective plate; and a light passing cover mounted between the first lower side of the first reflective plate and the second lower side of the second reflective plate, wherein the light source emits a first light passing through the light passing cover, wherein the light source emits a second light with directions guided by the first reflective plate and the second reflective plate, wherein a first rotation connector attaches the first upper side of the first reflective plate to the top edge of the first wall.

2. The lighting apparatus of claim 1, wherein a first angle between the first top edge of the first wall and the upper side of the first reflective plate is smaller than 90 degrees.

3. The lighting apparatus of claim 2, wherein the first upper side of the first reflective plate has a larger distance to the bottom plate than the first lower side of the first reflective plate to the bottom plate.

4. The lighting apparatus of claim 2, wherein the first angle is adjustable to change a first tilt angle of the first reflective plate with respect to the bottom plate.

5. The lighting apparatus of claim 1, wherein the first rotation connector has a lever to release a connection of the first upper side of the first reflective plate to the first top edge of the first wall.

6. The lighting apparatus of claim 5, wherein the first rotation connector has an elastic unit for generating an elastic force for attaching the first reflective plate to the first wall while no external force is applied on the lever.

7. The lighting apparatus of claim 1, wherein the lower side of the first reflective plate is attached to the bottom plate with a first pressing rotator, wherein the first pressing rotator has a pin being rotated to press the first lower side of the first reflective plate to the bottom plate.

8. The lighting apparatus of claim 7, wherein the first pressing rotator is concealed by the light passing cover.

9. The lighting apparatus of claim 7, further comprising a manual switch, wherein the manual switch is concealed by the light passing cover, wherein the manual switch is operated to change a setting of the light source.

10. The lighting apparatus of claim 7, wherein the light source comprises at least one light strip containing LED modules.

11. The lighting apparatus of claim 10, wherein the light strip has a light cover to prevent engagement of human to the LED modules enclosed by the light cover.

12. The lighting apparatus of claim 1, wherein a driver is enclosed by the first wall, the first reflective plate, and the bottom plate.

13. The lighting apparatus of claim 1, wherein the first reflective plate has a metal substrate.

14. The lighting apparatus of claim 13, wherein the first lower side of the first reflective plate has a first bending part, wherein the bending part has a first protruding pin for buckling a first cover edge of the light passing cover.

15. The lighting apparatus of claim 14, wherein the light passing cover is made of plastic material.

16. The lighting apparatus of claim 15, wherein the first cover edge of the light passing cover is pressed to deform for the first cover edge to escape from the first protruding pin.

17. The lighting apparatus of claim 16, wherein the first bending part and the first protruding pin are made of the same metal piece of the first reflective plate.

18. The lighting apparatus of claim 13, wherein heat of the light source is transmitted to the first reflective plate.

19. The lighting apparatus of claim 18, wherein a metal path is disposed for guiding heat of the light source to the first reflective plate.

* * * * *